US012053854B2

(12) United States Patent
Kyoshima et al.

(10) Patent No.: US 12,053,854 B2
(45) Date of Patent: Aug. 6, 2024

(54) SYNTHETIC GRINDSTONE, SYNTHETIC GRINDSTONE ASSEMBLY, AND METHOD OF MANUFACTURING SYNTHETIC GRINDSTONE

(71) Applicant: TOKYO DIAMOND TOOLS MFG. CO., LTD., Tokyo (JP)

(72) Inventors: Kai Kyoshima, Tokyo (JP); Takeshi Yagi, Tokyo (JP)

(73) Assignee: TOKYO DIAMOND TOOLS MFG. CO., LTD., Tokyo (JP)

( * ) Notice: Subject to any disclaimer, the term of this patent is extended or adjusted under 35 U.S.C. 154(b) by 0 days.

(21) Appl. No.: 18/346,898

(22) Filed: Jul. 5, 2023

(65) Prior Publication Data

US 2024/0025011 A1 Jan. 25, 2024

(30) Foreign Application Priority Data

Jul. 19, 2022 (JP) ..... 2022-115035
Aug. 31, 2022 (JP) ..... 2022-138397

(51) Int. Cl.
*B24D 18/00* (2006.01)
*B24B 37/24* (2012.01)
*B24D 11/00* (2006.01)

(52) U.S. Cl.
CPC ..... *B24B 37/245* (2013.01); *B24D 11/001* (2013.01); *B24D 18/0009* (2013.01)

(58) Field of Classification Search
CPC .. B24B 37/245; B24D 11/001; B24D 18/0009
See application file for complete search history.

(56) References Cited

U.S. PATENT DOCUMENTS 5,738,697 A * 4/1998 Wu ..... B24D 3/18 51/296
6,679,758 B2 1/2004 Bright et al.
6,685,755 B2 2/2004 Ramanath et al.
6,755,729 B2 7/2004 Ramanath et al.
7,077,723 B2 7/2006 Bright et al.
7,422,513 B2 9/2008 Bright et al.
(Continued)

FOREIGN PATENT DOCUMENTS

CN 1589189 A 3/2005
CN 112135710 A 12/2020
(Continued)

OTHER PUBLICATIONS

Japanese Office Action dated Nov. 1, 2022 received in 2022-138397.
(Continued)

*Primary Examiner* — James A Fiorito
*Assistant Examiner* — Ross J Christie
(74) *Attorney, Agent, or Firm* — Scully, Scott, Murphy & Presser, P.C.

(57) ABSTRACT

A synthetic grindstone for performing a surface processing includes abrasive grains with an abrasive grain proportion (Vg) higher than 0 vol. % and equal to or lower than 40 vol. %, includes a nonwoven-fabric binder with a binder proportion (Vb) equal to or higher than 35 vol. % and lower than 90 vol. %. The synthetic grindstone has a porosity (Vp) higher than 10 vol. % and equal to or lower than 55 vol. %.

6 Claims, 5 Drawing Sheets

(56) References Cited

U.S. PATENT DOCUMENTS

| | | | |
|---|---|---|---|
| 2003/0097800 | A1 | 5/2003 | Ramanath et al. |
| 2003/0194947 | A1 | 10/2003 | Bright et al. |
| 2003/0232586 | A1 | 12/2003 | Ramanath et al. |
| 2005/0101225 | A1 | 5/2005 | Bright et al. |
| 2006/0160476 | A1 | 7/2006 | Bright et al. |
| 2008/0156657 | A1 | 7/2008 | Butterfield et al. |
| 2008/0293345 | A1 | 11/2008 | Bright et al. |
| 2010/0037530 | A1 | 2/2010 | Yoshida et al. |
| 2017/0190023 | A1 | 7/2017 | Pacella et al. |
| 2021/0362298 | A1 | 11/2021 | Ogasawara et al. |
| 2022/0023997 | A1 | 1/2022 | Kyoshima |
| 2022/0080556 | A1 | 3/2022 | Yamahara et al. |

FOREIGN PATENT DOCUMENTS

| | | | |
|---|---|---|---|
| GB | 1108303 | A | 4/1968 |
| JP | 2000-190232 | A | 7/2000 |
| JP | 2004-087912 | A | 3/2004 |
| JP | 2005-103647 | A | 4/2005 |
| JP | 2006-320992 | A | 11/2006 |
| JP | 2008-030194 | A | 2/2008 |
| JP | 2008-137126 | A | 6/2008 |
| JP | 2009-034817 | A | 2/2009 |
| JP | 2010-105060 | A | 5/2010 |
| JP | 4573492 | B2 | 11/2010 |
| JP | 2017-047499 | A | 3/2017 |
| JP | 2017-226057 | A | 12/2017 |
| JP | 2020-104250 | A | 7/2020 |
| JP | 2021-003795 | A | 1/2021 |
| KR | 101503545 | B1 | 3/2015 |

OTHER PUBLICATIONS

Extended European Search Report dated Dec. 11, 2023 received in 23183555.4.

Korean Office Action dated Nov. 13, 2023 received in 10-2023-0082268.

Chinese Office Action dated Apr. 19, 2024 received in 202310868375.9.

* cited by examiner

SYNTHETIC GRINDSTONE, SYNTHETIC GRINDSTONE ASSEMBLY, AND METHOD OF MANUFACTURING SYNTHETIC GRINDSTONE

CROSS REFERENCE TO RELATED APPLICATIONS

This application is based upon and claims the benefit of priority from prior Japanese Patent Applications No. 2022-115035, filed Jul. 19, 2022, and No. 2022-138397, filed Aug. 31, 2023, the entire contents of which are incorporated herein by reference.

FIELD

The present invention relates to a synthetic grindstone, a synthetic grindstone assembly, and a method of manufacturing a synthetic grindstone for performing a surface processing, such as chemo-mechanical grinding (CMG).

BACKGROUND

A surface processing may be performed by means of dry chemo-mechanical grinding (CMG) (e.g., Japanese Patent No. 4573492). In a CMG process, a synthetic grindstone obtained by fixing abrasives (abrasive grains) with a resin binder such as a thermoplastic resin is used. The synthetic grindstone is pressed against a wafer while the wafer and the synthetic grindstone are rotated (e.g., Japanese Patent KOKAI Publication No. 2004-87912). By being heated and oxidized by friction with the synthetic grindstone, convex portions on the surface of the wafer become brittle, and are peeled off. In this manner, only the convex portions of the wafer are ground and planarized.

SUMMARY

A synthetic grindstone for performing a surface processing according to an aspect of the present invention includes abrasive grains with an abrasive grain proportion (Vg) higher than 0 vol. % and equal to or lower than 40 vol. %, and a nonwoven-fabric binder with a binder proportion (Vb) equal to or higher than 35 vol. % and lower than 90 vol. %. The synthetic grindstone has a porosity (Vp) higher than 10 vol. % and equal to or lower than 55 vol. %.

DETAILED DESCRIPTION

Figure 1:
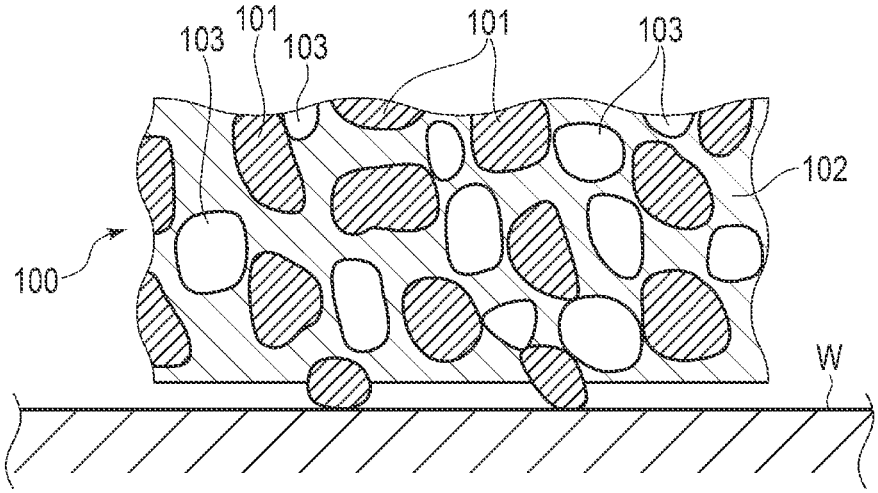
FIG. 1 is a schematic diagram showing a structure of a synthetic grindstone according to an embodiment.

As shown in FIG. 1, a synthetic grindstone 100 is formed of abrasive grains (abrasives) 101 and a binder 102. The synthetic grindstone 100 may further include pores 103. In the synthetic grindstone 100 of the present embodiment, the abrasive grains 101 are dispersively retained in the binder 102, and the pores 103 are dispersively disposed in the binder 102.

If an object to be ground is silicon, it is preferable, for example, that a silica, a cerium oxide, or a mixture thereof be applied as the abrasive grains 101; however, the configuration is not limited thereto. Similarly, if an object to be ground is sapphire, it is preferable that a chromic oxide, a ferric oxide, or a mixture thereof, etc. be applied. Other applicable abrasives that may be used depending on the type of the object to be ground include alumina, silicon carbide, or a mixture thereof.

In the present embodiment, an example will be explained in which the object to be ground is silicon, and a cerium oxide with an average grain size of, for example, approximately fpm is used as the abrasive grains 101. The grain size of the abrasive grains 101 can be suitably set; however, it is preferable that it be, for example, smaller than 5 μm.

In the present embodiment, a nonwoven fabric is used as the binder 102. Examples of the nonwoven fabric that can be used include polyester short fibers. Examples of the polyester short fibers that can be used include polyethylene terephthalate (PET) short fibers.

Figure 2:
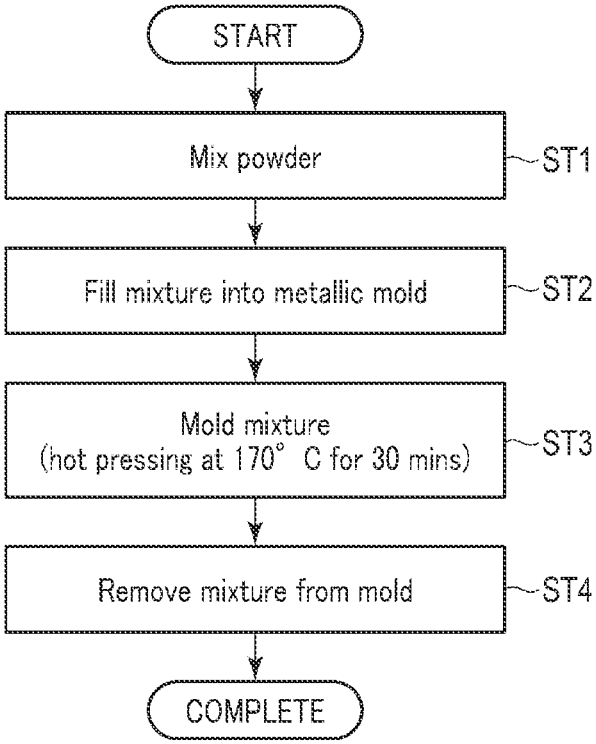
FIG. 2 is a schematic diagram showing a manufacturing flow (manufacturing method) of a synthetic grindstone (molded body).

The synthetic grindstone (molded body) 100 is formed based on the flow (manufacturing method) shown in FIG. 2.

First, a mixed material (mixed powder) is obtained by mixing abrasive grains 101 with a short-fiber binder 102 for forming a nonwoven fabric at volume proportions shown in FIG. 3, to be described below (step ST1). At this stage, the binder 102 is observed, not under magnification, in an approximately powder form.

Subsequently, the mixed material is filled into a metallic mold for forming the mixed material into a final shape of the synthetic grindstone 100 (step ST2). At this time, the fibers can be integrated using dry, wet, or other methods. The synthetic grindstone 100 is pressure-molded (hot-pressed) at 170° C. for 30 minutes, and is molded into a molded body (step ST3). Thereafter, the molded body in the metallic mold is removed from the mold (step ST4).

Figure 3:
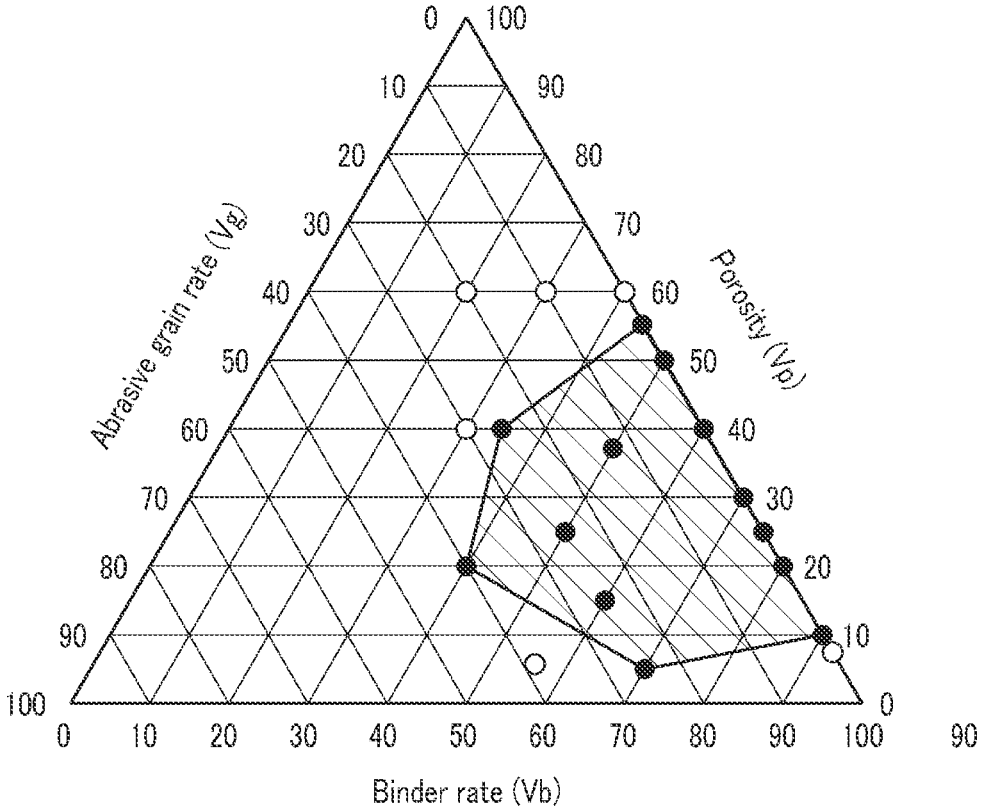
FIG. 3 is a three-phase diagram showing three aspects (an abrasive grain proportion (Vg), a binder proportion (Vb), and a porosity (Vp)) of a synthetic grindstone produced with a nonwoven fabric.

FIG. 3 shows a three-phase diagram showing "three aspects" (i.e., an abrasive grain proportion (Vg), a binder proportion (Vb), and a porosity (Vp)) of the above-described synthetic grindstone 100 produced with a nonwoven fabric.

Figure 4:
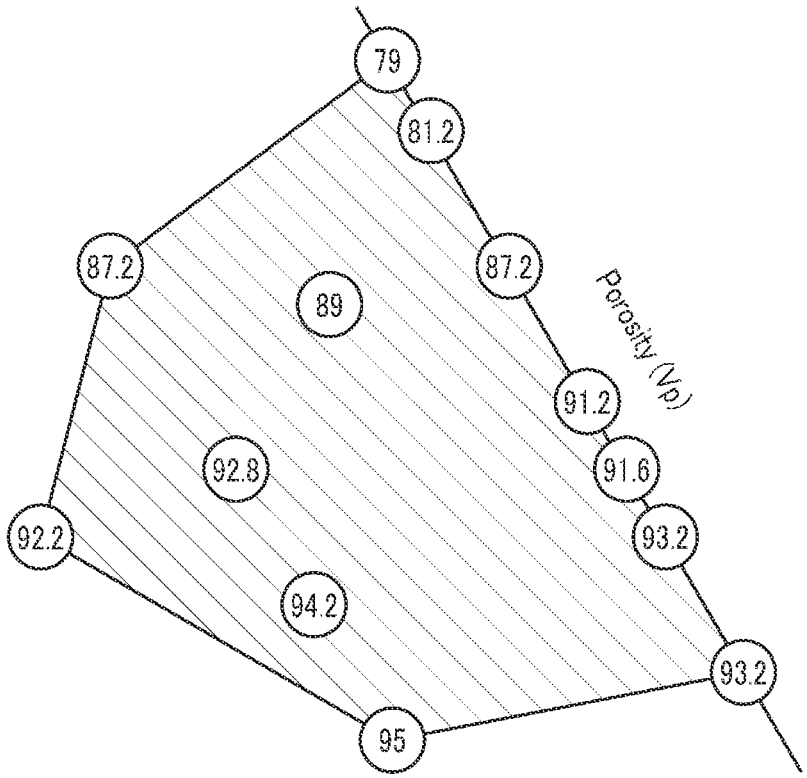
FIG. 4 shows hardness measurements of the synthetic grindstone at the respective points shown in FIG. 3.
Figure 5:
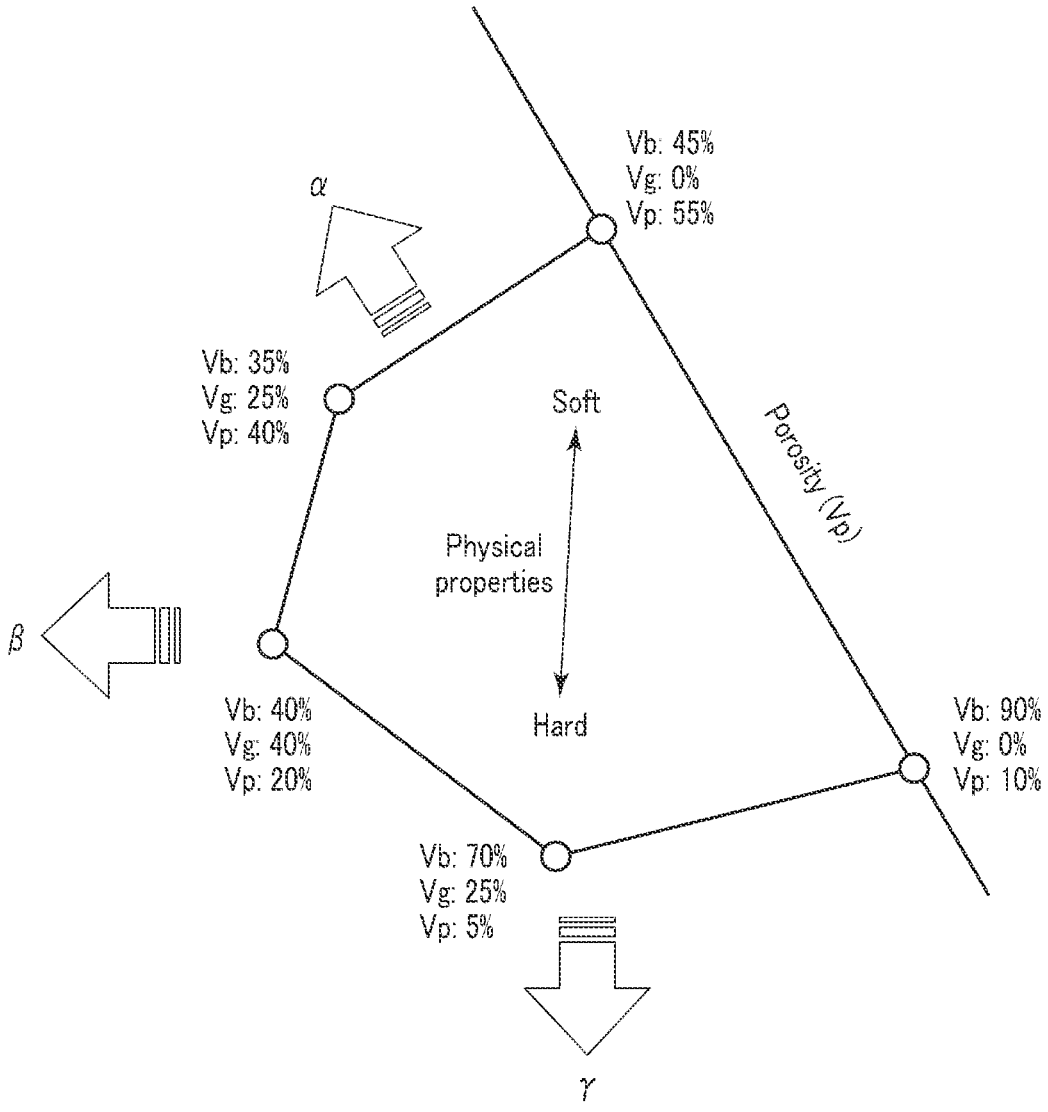
FIG. 5 is a schematic diagram showing a boundary indicating whether or not the nonwoven-fabric synthetic grindstone shown in FIG. 3 can be manufactured.

FIGS. 3 to 5 show experiment results (19 products) obtained in an attempt to produce a synthetic grindstone 100 by suitably adjusting three aspects (an abrasive grain proportion (Vg), a binder proportion (Vb), and a porosity (Vp)) of the synthetic grindstone 100. Through the experiments, a boundary indicating whether or not a synthetic grindstone 100 can be created has been formed. It has been found that a product with a composition falling inside the boundary shown in FIG. 5 is usable as a synthetic grindstone 100.

Of the 19 products in total, 13 products were formed into a synthetic grindstone 100 durable for use. The 13 products were formed with an abrasive grain proportion (Vg) of abrasive grains falling in a range from 0 vol. % to vol. %, with a binder proportion (Vb) equal to or higher than 35 vol. % and lower than 90 vol. %, and with a porosity (Vp) of pores higher than 10 vol. % and lower than 55 vol. %. It can be seen that a product shown in FIGS. 3 to 5 with an abrasive grain proportion of 0 vol. % was formed into a synthetic grindstone 100. Since a synthetic grindstone 100 whose abrasive grain proportion is 0 vol. % does not contain abrasive grains 101, the abrasive grain proportion of such a synthetic grindstone 100 becomes higher than 0 vol. % in actuality. For the synthetic grindstone 100 of the present embodiment, the abrasive grain proportion (Vg) of the abrasive grains 101 is determined first, and then the binder proportion (Vb) of the binder 102 is set.

Figure 6:
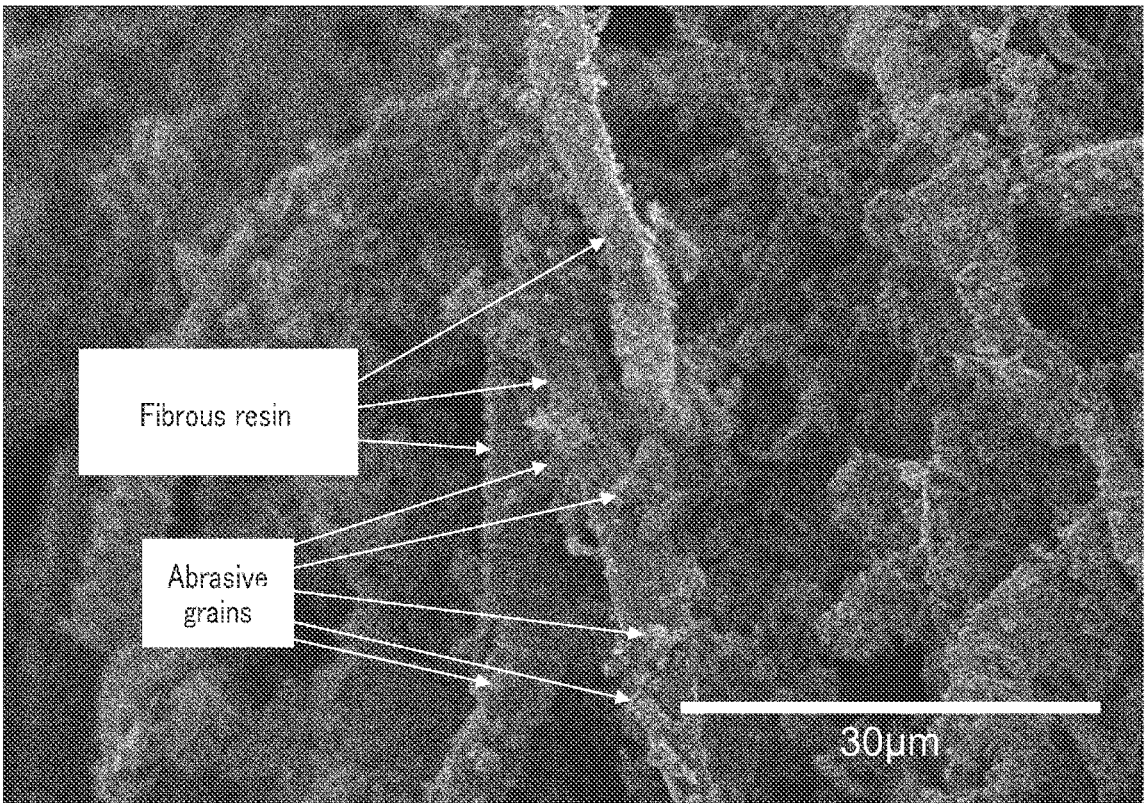
FIG. 6 shows an image in which a synthetic grindstone that is durable for use is magnified by 1500 times.

FIG. 6 shows an electron scanning microscope image in which one of the 13 synthetic grindstones 100 that are durable for use is magnified by 1500 times. FIG. 6 shows the presence of a nonwoven-fabric binder 102 in the synthetic grindstone 100. FIG. 6 shows the presence of, as well as a nonwoven-fabric fibrous resin (in an elongated shape), which is the binder 102, granular abrasive grains 101 adhering to the fibrous resin.

The 13 products found to be usable as a synthetic grindstone 100 were subjected to a durometer hardness measurement (ASTM D 2240-05 Type DO). FIG. 4 shows hardness measurements of the synthetic grindstone 100 at respective points shown in FIG. 3. As shown in FIGS. 3 to 5, it can be seen that the synthetic grindstone 100 becomes relatively soft as the porosity increases, and becomes relatively hard as the porosity decreases.

Hereinafter, the six products that were not formed into a synthetic grindstone 100 will be referred to as "molded bodies". Of the 19 products in total, the remaining six products had a composition beyond the boundary shown in FIG. 5, and were molded bodies not formed into a synthetic grindstone 100. Of the molded bodies beyond the boundary shown in FIG. 5, those in a region indicated by an arrow α had a high porosity and a low fill density. It can thus be presumed that corners and surfaces of such molded bodies crumbled greatly because of insufficient binding of the binder. Of the molded bodies beyond the boundary shown in FIG. 5, those in a region indicated by an arrow β had a low porosity and a sufficiently high fill density. It can be presumed that such molded bodies had a powdered surface because of a low binding rate of the binder. It can be presumed that, of the molded bodies beyond the boundary shown in FIG. 5, those in a region indicated by an arrow γ had an excessively low porosity and an excessively high fill density. It can be seen that such molded bodies did not have specified dimensions at the time of molding.

It can be presumed that an excessively high abrasive grain proportion also resulted in crumbling of the molded bodies because of failure of binding. It is preferable that the abrasive grain proportion be, for example, higher than 0 vol. % and equal to or below 40 vol. %, as described above.

Thus, it can be seen that a synthetic grindstone 100 that uses a nonwoven fabric as a binder cannot be molded unless each of the abrasive grain proportion, the binder proportion, and the porosity is set to a volume proportion within a predetermined range.

In the present embodiment, it is assumed that the synthetic grindstone 100 is formed in a disc shape and used in a dry chemo-mechanical grinding (CMG) processing in which the synthetic grindstone 100 is treated by both a mechanical action and a chemical-component-based composition action. That is, the synthetic grindstone 100 exerts a dry chemo-mechanical grinding action on a surface of a wafer W, which is an object to be ground, and performs a surface processing on the wafer W to be ground. Thereafter, a synthetic grindstone assembly 200 is formed by fixing the synthetic grindstone 100 to a grindstone retaining member (substrate) 43 with a double-sided tape, an adhesive, or the like, and is then attached to a CMG device 10 shown in FIG. 7 and used for a surface processing of the wafer W, which is an object to be ground. The grindstone retaining member 43 may be of any material which has a suitable stiffness that is resistant to a CMG processing, which has a heat resistance up to a temperature that may be increased by use of the synthetic grindstone 100, and which is not thermally softened, and examples of such a material include an aluminum alloy material.

Figure 7:
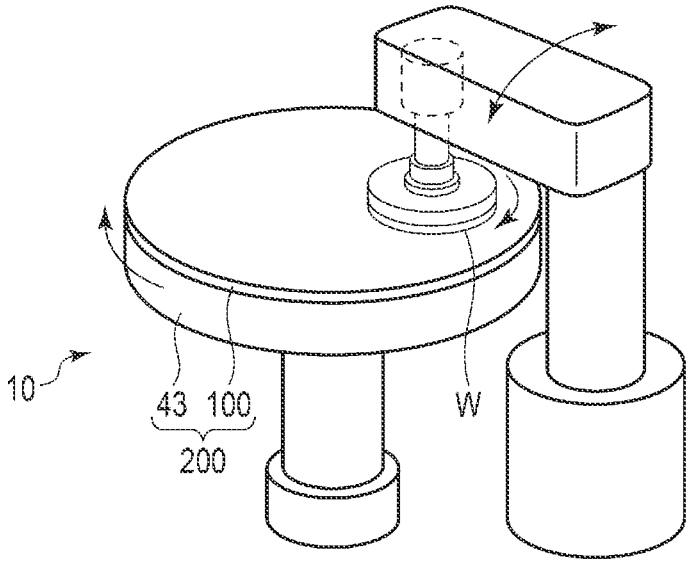
FIG. 7 is a schematic diagram showing a CMG device used for a processing of an object to be ground.

The wafer W, which is an object to be ground, is pressed against the synthetic grindstone 100 while the synthetic grindstone assembly 200, which includes the grindstone retaining member 43 and the synthetic grindstone 100, and the wafer W are rotated in an arrow direction shown in FIG. 7. At this time, the synthetic grindstone 100 is rotated at a circumferential velocity of, for example, 600 m/min, and the wafer W is pressed at a processing pressure of 300 g/cm$^2$. This allows the synthetic grindstone 100 and the surface of the wafer W to slidably move. After the processing starts, the synthetic grindstone 100 and the surface of the wafer W slidably move, and an external force acts on the binder 102. Through continuous action of the external force and advancement of the CMG process, abrasive grains (abrasives) gradually fall out from a surface (surface of action of a mirror surface processing) of the binder 102 of the synthetic grindstone 100 facing the surface of the wafer W to be ground. Through a chemo-mechanical grinding action of fixed abrasive grains 101 retained in a nonwoven fabric, which is the binder 102, or abrasive grains 101 dislodged out of the nonwoven fabric, which is the binder 102, the surface of the wafer W is ground. By being heated and oxidized by friction with the synthetic grindstone 100, convex portions on the surface of the wafer W become brittle, and are peeled off. In this manner, through grinding of only the convex portions on the surface of the wafer W, the surface of the wafer W is planarized.

In the present embodiment, a nonwoven fabric is used as the binder 102 instead of using a thermoplastic resin material (e.g., ethyl cellulose) as a binder. Accordingly, an elastic deformation amount of the binder 102 can be made great compared to the case where a thermoplastic resin material is used as a binder. With such a configuration, the synthetic grindstone 100 according to the present embodiment is excellent in trackability to the surface of the wafer W, which is an object to be ground (processed object).

In the case of using a thermoplastic resin material as a binder, if heat accumulates between the synthetic grindstone and the wafer W, the thermoplastic resin material used as the binder is softened, thus causing elution, etc. at the surface of the synthetic grindstone. If the thermoplastic resin material used as the binder melts and adhesion to the surface of the wafer W, referred to as "sticking", occurs, a grinding resistance of the synthetic grindstone suddenly increases, possibly causing surface roughness and scratches of the wafer W.

On the other hand, if a nonwoven fabric is used as the binder 102 as in the synthetic grindstone 100 according to the present embodiment, even if heat accumulates in the binder 102, elution at the surface of the synthetic grindstone 100 does not occur. It is thereby possible to prevent the binder 102 from being melted even if heat accumulates between the synthetic grindstone 100 and the wafer W. With such a configuration, the synthetic grindstone 100 according to the present embodiment can maintain stable processing properties for a longer period of time. It is thereby possible to prevent unintended scratches from occurring on the surface of the wafer W, which is an object to be ground. Thus, by using the nonwoven-fabric binder 102 according to the present embodiment, the object to be ground (worked surface) can be ground softly compared to the case where a thermoplastic resin material is used as a binder, thereby contributing to a decrease in damage to the object to be ground.

Behind this, the present inventors have made every effort to prevent occurrence of excessive frictional heat at the time of performing, for example, a dry mirror surface processing, and discovered that a synthetic grindstone 100 formed to satisfy the three aspects of the grindstone of the above-described three-phase diagram achieves excellent processing properties on the object to be ground. That is, a synthetic grindstone 100 preferable for performing a dry surface processing includes abrasive grains 101 with an abrasive grain proportion (Vg) higher than 0 vol. % and equal to or lower than 40 vol. %, includes a nonwoven-fabric binder 102 with a binder proportion (Vb) equal to or higher than 35 vol. % and lower than 90 vol. %, and has a porosity (Vp) higher than 10 vol. % and equal to or lower than 55 vol. %. By using the synthetic grindstone 100 according to the present embodiment, it is possible, at the time of performing, for example, a dry mirror surface processing, to suppress excessive frictional heat from occurring between the synthetic grindstone 100 and the object to be ground, through the employment of a chemical solid-phase reaction that locally occurs under a high temperature and a high pressure between the synthetic grindstone 100 and the object to be ground. By performing, for example, a dry mirror surface processing on the object to be ground using the synthetic grindstone 100 according to the present embodiment, it is possible to achieve a processing (mirror surface processing) with extreme flatness, with a surface roughness of the object to be ground on the sub-nanometer order.

According to the present embodiment, it is possible, at the time of performing, for example, a dry mirror surface processing, to provide a synthetic grindstone 100, a synthetic grindstone assembly 200, and a method of manufacturing the synthetic grindstone 100 capable of suppressing occurrence of excessive frictional heat.

In the present embodiment, a range of volume proportions within which a synthetic grindstone 100 can be formed has been set with respect to the example of using PET short fibers as a nonwoven fabric of the binder 102. For the nonwoven fabric used as the binder 102, polyamide (PA) short fibers or polypropylene (PP) short fibers, as well as polyester short fibers, may be used. For the nonwoven fabric, one or more of polyester short fibers, polyamide (PA) short fibers, and polypropylene (PP) short fibers may be selectively used. Even if such fibers are used as the nonwoven fabric of the binder 102, the above-described range of volume proportions including the abrasive grain proportion (Vg), the binder proportion (Vb), and the porosity (Vp) may be set similarly to the case of using PET short fibers. The configuration of the nonwoven fabric used as the binder 102 is not limited thereto. For example, a long-fiber nonwoven fabric may be used. Examples of the long-fiber nonwoven fabric that may be used include polyester long fibers, polypropylene long fibers, etc., and a mixture thereof.

A short-fiber nonwoven fabric refers to a fabric using cut fibers, and a long-fiber nonwoven fabric refers to a fabric using an endless fiber. For a short-fiber nonwoven fabric that uses cut fibers, the length of fibers can be suitably set. The length of fibers of the short-fiber nonwoven fabric is on the order of microns. The long-fiber nonwoven fabric uses fibers with connected length equal to, for example, a winding length. For example, if the winding length is 100 m, a single fiber is approximately 100 m in length.

In the present embodiment, an example has been explained in which the synthetic grindstone 100 is provided in a disk shape. The synthetic grindstone 100 may be formed in a pellet shape, an elongated cuboid shape, or another shape. The synthetic grindstone assembly 200 is formed in a suitable shape that retains the synthetic grindstone 100.

An example has been explained in which the synthetic grindstone 100 according to the present embodiment is used in a dry processing; however, it may also be used in, for example, a wet processing using grinding water (e.g., pure water).

(First Modification)

A case will be explained where a synthetic grindstone 100 according to the present modification contains, as a first filler, coarse particles with a suitable size.

It is preferable that the first filler be, for example, in a spherical shape; however, the first filler need not necessarily be in a spherical shape, and may be of a massive form that may include irregularities and/or deformations. The first filler is, for example, silica, and is dispersively fixed by a binder 102 formed of a nonwoven fabric. It is preferable that the first filler contain silica with a grain size larger than that of the abrasive grains 101, and silica with a smaller grain size fixed to the periphery of the silica with the larger grain size. It is preferable that the grain size of the silica with the smaller grain size be smaller than that of the abrasive grains 101. A volume proportion of the first filler in the synthetic grindstone 100 is set by a correlation with a binder proportion (Vb) of the binder 102 based on, for example, an abrasive grain proportion (Vg) of the abrasive grains 101. That is, for the synthetic grindstone 100 of the present modification, an abrasive grain proportion (Vg) of the abrasive grains 101 is determined first, and then a binder proportion (Vb) of the binder 102 and a volume proportion of the first filler are set based on a correlation between the binder 102 and the first filler. It is preferable that the first filler be larger than 0 vol. % and equal to or smaller than 40 vol. %.

The abrasive grains 101, which are formed of a cerium oxide, have a hardness equivalent to or lower than a wafer W to be ground, and are composed mainly of silicon or an oxide thereof. As compared to the abrasive grains 101, the first filler, which is formed of silica, has a hardness equivalent to or lower than the wafer W, or an oxide thereof.

The synthetic grindstone 100 including the abrasive grains 101, the nonwoven-fabric binder 102, and the first filler is manufactured as explained in the above-described embodiment.

Since the average grain size of the first filler is larger than that of the abrasive grains 101, the synthetic grindstone 100 and the wafer W are, during a processing, brought in near contact with each other via vertexes of the particles of the first filler. That is, since the first filler is present between a matrix (i.e., the abrasive grains 101 and the nonwoven-fabric binder 102) of the synthetic grindstone 100 and the wafer W, the matrix and the wafer W are not brought in direct contact, and a certain clearance occurs.

If a processing is started with the first filler being in contact with the wafer W, an external force acts on the matrix. Through continuous action of the external force, the abrasive grains 101 are dislodged out of the matrix. The dislodged abrasive grains 101 are present at a processing interface in a state of adhering to the first filler in the clearance between the synthetic grindstone 100 and the wafer W. Accordingly, the abrasive grains 101 and the wafer W are, during the processing, brought in near contact with each other via vertexes of the particles of the first filler. Thereby, an actual contact area between the abrasive grains 101 and the wafer W becomes significantly small, thus increasing a working pressure at the point of processing. This advances the grinding processing with a high processing efficiency.

The clearance promotes replacement of air in the neighborhood of the surface of the wafer W with fresh air, thereby cooling the worked surface. Also, the sludge caused by the abrasive grains 101 is discharged from the wafer W to the outside via the clearance, thereby preventing the surface of the wafer W from being damaged. As a result, it is possible to prevent burns, scratches, etc. on the surface of the wafer W caused by frictional heat.

In this manner, the wafer W is ground with the synthetic grindstone 100 to have a planar surface with a predetermined roughness.

With the synthetic grindstone 100 according to the present modification, it is possible to maintain a high processing efficiency by maintaining a sufficient contact pressure between the abrasive grains 101 and the wafer W even in an advanced stage of the processing, and to prevent a decrease in the quality of the wafer W and occurrence of scratches by suppressing direct contact between the binder 102 and the wafer W. In the present modification, with the heat generated between the synthetic grindstone 100 and the object to be ground, it is possible to suppress generation of excessive frictional heat, as explained in the above-described embodiment.

Examples of the first filler that may be applied include silica, carbon, silica gel (which is a porous body of them), activated charcoal, and a spherical resin. It is to be noted that a hollow balloon, which is used as a pore forming agent, is not appropriate, since it may burst during the processing and cause scratches.

(Second Modification)

A case will be explained where a synthetic grindstone 100 according to the present modification contains, as a second filler, an electrically conductive substance of a suitable size smaller than that of the first filler explained in the first modification. In the present modification, an example will be described in which an aluminum alloy material, for example, is used as a material of the grindstone retaining member 43 of the above-described CMG device 10 having an electrical conductivity and a suitable level of thermal conductivity.

Examples of the electrically conductive material include carbon nanotubes. Such substances have an average grain size smaller than that of the abrasive grains 101. A volume proportion of the second filler in the synthetic grindstone 100 is set by a correlation with a binder proportion (Vb) of the binder 102 based on, for example, an abrasive grain proportion (Vg) of the abrasive grains 101. That is, for the synthetic grindstone 100 of the present modification, an abrasive grain proportion (Vg) of the abrasive grains 101 is determined first, and then a binder proportion (Vb) of the binder 102 and a volume proportion of the second filler are set based on a correlation between the binder 102 and the second filler. It is preferable that the second filler be added at a volume proportion larger than 0 vol. % and equal to or smaller than 10 vol. %. By using, for example, carbon nanotubes as the second filler, the intensity of the synthetic grindstone 100 can be improved as a structure.

As the processing of the wafer W is started with the CMG device 10, the synthetic grindstone 100 and the wafer W slidably move, thus causing an external force to act on the binder 102. Through continuous action of the external force, the abrasive grains 101 are dislodged. The dislodged abrasive grains 101 slidably move in the clearance between the synthetic grindstone 100 and the wafer W. Through a chemo-mechanical grinding action of the abrasive grains 101, the surface of the wafer W is ground.

If the surface of the wafer W is ground and a friction occurs, static electricity may occur on the surface of the wafer W. At this time, the second filler, which is electrically conductive, allows the static electricity on the surface of the wafer W to flow through the grindstone retaining member 43 (see FIG. 7). Accordingly, by using the synthetic grindstone 100 according to the present embodiment, static electricity occurring on the surface of the wafer W can be discharged while grinding the surface of the wafer W. As a result, it is possible to prevent adhesion of dust, etc. to the surface of the wafer W.

In the present modification, the grindstone retaining member 43 has a high thermal conductivity compared to the synthetic grindstone 100. If the surface of the wafer W is ground and a friction occurs, frictional heat occurs on the surface of the wafer W. At this time, the second filler absorbs the frictional heat, and the heat absorbed by the second filler is conducted to the grindstone retaining member 43. Accordingly, by using the synthetic grindstone 100 according to the present modification, frictional heat occurring on the surface of the wafer W can be removed by grinding the surface of the wafer W. As a result, it is possible to prevent occurrence of burns on the surface of the wafer W caused by frictional heat between the surface of the synthetic grindstone 100 and the surface of the wafer W, and to prevent scratches. With the synthetic grindstone 100 according to the present modification, it is possible to provide a preferable surface processing of the wafer W, and to increase the lifespan of the synthetic grindstone 100.

It is also preferable that a heat dissipator such as heat radiation fins be provided on the grindstone retaining member 43, which rotates together with the synthetic grindstone 100, namely, it is preferable that the synthetic grindstone assembly 200 include a heat dissipator (heat transfer section). In this case, the heat dissipator is brought in contact with air, causing the heat of the synthetic grindstone 100 to be effectively dissipated.

It is also possible to arrange water piping for cooling water in the grindstone retaining member 43, thereby cooling the grindstone retaining member 43 and the synthetic grindstone 100.

In the present modification, an example has been explained in which the grindstone retaining member 43 has an electrical conductivity and a higher thermal conductivity than that of the synthetic grindstone 100; however, the grindstone retaining member 43 may be of a material having at least one of an electrical conductivity or a thermal conductivity higher than that of the synthetic grindstone 100. In the case of the grindstone retaining member 43 having an electrical conductivity, it is possible to remove the static electricity between the object to be ground and the synthetic grindstone 100; in the case of the grindstone retaining member 43 having a thermal conductivity higher than that of the synthetic grindstone 100, it is possible to effectively dissipate heat that may occur in the synthetic grindstone 100.

In the first modification, an example has been explained in which the first filler is used, and in the second modification, an example has been explained in which the second filler is used. It is also preferable that the synthetic grindstone 100 include both the first filler and the second filler.

(Third Modification)

A case will be explained where a synthetic grindstone 100 according to the present modification contains, as a third filler, particles of a suitable size smaller than that of the first filler explained in the first modification.

Examples of the particles of the third filler include green carborundum (GC). Such particles have a hardness higher than the wafer W, which is an object to be ground. The particles of the third filler such as GC may be greater than or smaller than the average grain size of the abrasive grains 101. As a matter of course, the particles such as GC may be of a size equivalent to the average grain size of the abrasive grains 101.

The average grain size of the abrasive grains 101 based on a metal oxide such as an aluminum oxide (alumina), a zirconium oxide (zirconia), a cerium oxide (ceria), and a silicon oxide (silica) may be greater than, smaller than, or equivalent to that of GC. For example, average grain sizes of the alumina-based, zirconia-based, or ceria-based abrasive grains 101 are mostly greater than that of GC. For example, the average grain size of alumina-based abrasive grains 101 may be equivalent to the size of GC (smaller than 200 nm). If, for example, the particle size of GC, etc. is 10 nm, the average grain size of the abrasive grains 101 based on silica, etc. may be 1 nm. A volume proportion of the third filler in the synthetic grindstone 100 is set by a correlation with a binder proportion (Vb) of the binder 102 based on, for example, an abrasive grain proportion (Vg) of the abrasive grains 101. It is preferable that the third filler be added at a volume proportion larger than 0 vol. % and equal to or smaller than vol. %.

A technique (gettering effect) is known in which a gettering site such as fine flaws is formed on a back surface, opposite to a top surface, of the wafer W, and impurities are captured in the gettering site. GC, which has a hardness higher than the back surface of the wafer W, is used to intentionally make flaws on the back surface of the wafer W.

In the present modification, with the heat generated between the synthetic grindstone 100 and the object to be ground, it is possible to suppress generation of excessive frictional heat, as explained in the above-described embodiment. Since GC has electrical conductivity, it is possible to suppress static electricity occurring between the synthetic grindstone 100 and the object to be ground.

The present invention is not limited to the above-described embodiments, and can be modified in various manners in practice, without departing from the gist of the invention. Moreover, the embodiments can be suitably combined; in such case, combined advantages are obtained. Furthermore, the above-described embodiments include various inventions, and various inventions can be extracted by a combination selected from structural elements disclosed herein. For example, if the problem can be solved and the effects can be attained even after some of the structural elements are deleted from all the structural elements disclosed in the embodiment, the structure made up of the resultant structural elements may be extracted as an invention.

What is claimed is:

1. A synthetic grindstone for performing a surface processing on an object to be ground, comprising:

abrasive grains having an abrasive grain proportion (Vg) higher than 0 vol. % and equal to or lower than 40 vol. %; and a nonwoven-fabric binder having a binder proportion (Vb) equal to or higher than 35 vol. % and lower than 90 vol. %, wherein the synthetic grindstone has a porosity (Vp) higher than 10 vol. % and equal to or lower than 55 vol. %.

2. The synthetic grindstone according to claim 1, wherein the nonwoven-fabric binder includes at least one of polyester short fibers, polyamide short fibers, or polypropylene short fibers.

3. The synthetic grindstone according to claim 1, wherein:

the synthetic grindstone is used to perform the surface processing in a dry manner, and the synthetic grindstone includes at least one of a first filler having an average grain size greater than the abrasive grains, a second filler having an electrical conductivity, or a third filler having a hardness higher than the object to be ground.

4. The synthetic grindstone according to claim 1, wherein the synthetic grindstone exerts a dry chemo-mechanical grinding action on the object to be ground.

5. A synthetic grindstone assembly comprising:

the synthetic grindstone according to claim 3; and a substrate to which the synthetic grindstone is fixed and which has at least one of an electrical conductivity or a thermal conductivity higher than the synthetic grindstone.

6. A method for manufacturing the synthetic grindstone according to claim 1, comprising:

mixing the abrasive grains and the nonwoven-fabric binder to obtain a mixed material;

filling the mixed material into a metallic mold and molding the mixed material by hot pressing; and removing a molded body obtained by the molding from the metallic mold.

* * * * *